US008205649B2

(12) United States Patent
Yeh et al.

(10) Patent No.: US 8,205,649 B2
(45) Date of Patent: Jun. 26, 2012

(54) CUTTER ASSEMBLY AND ELECTRIC PENCIL SHARPENER

(75) Inventors: Long-Jyi Yeh, Xindian (TW); Chiu-Hung Chung, Toufen Township (TW); Yao-Jen Iai, Cingshuei Township (TW); Hsien-Cheng Lin, Chang Hua (TW); Chun-Peng Lin, Nantou (TW)

(73) Assignee: SDI Corporation, Chang Hua (TW)

( * ) Notice: Subject to any disclaimer, the term of this patent is extended or adjusted under 35 U.S.C. 154(b) by 190 days.

(21) Appl. No.: 12/652,097

(22) Filed: Jan. 5, 2010

(65) Prior Publication Data

US 2010/0175788 A1 Jul. 15, 2010

(30) Foreign Application Priority Data

Jan. 13, 2009 (TW) ..... 98101049 A

(51) Int. Cl.
*B43L 23/00* (2006.01)

(52) U.S. Cl. ..... 144/28.72; 144/28.8; 144/28.9

(58) Field of Classification Search ..... 144/28.1–28.9; 30/451, 453–457, 461, 462
See application file for complete search history.

(56) References Cited

U.S. PATENT DOCUMENTS

| | | | | |
|---|---|---|---|---|
| 3,678,975 | A * | 7/1972 | Imanishi et al. | 144/28.5 |
| 3,776,286 | A * | 12/1973 | Blanck | 144/28.5 |
| 7,669,619 | B2 * | 3/2010 | Sun | 144/28.72 |
| 7,699,082 | B2 * | 4/2010 | Peng | 144/28.4 |
| 2003/0213530 | A1 | 11/2003 | Ricono et al. | |
| 2006/0086416 | A1 | 4/2006 | Takada | |
| 2007/0039663 | A1 | 2/2007 | Chang | |
| 2007/0251105 | A1 | 11/2007 | Takada | |

* cited by examiner

*Primary Examiner* — Shelley Self
(74) *Attorney, Agent, or Firm* — Alan Kamrath; Kamrath IP Lawfirm, PA

(57) ABSTRACT

A cutter assembly for an electric pencil sharpener has a cutter bracket and a cutter. The cutter bracket has a pencil sharpening hole and an engaging structure. The pencil sharpening hole is defined in the cutter bracket for a pencil to be inserted into the pencil sharpening hole. The engaging structure is formed on the cutter bracket to engage a rotating frame in the electric pencil sharpener. The cutter is mounted rotatably on the cutter bracket. Accordingly, the cutter assembly is replaceable for the electric pencil sharpener when the cutter of the cutter assembly is damaged or worn.

10 Claims, 12 Drawing Sheets

CUTTER ASSEMBLY AND ELECTRIC PENCIL SHARPENER

BACKGROUND OF THE INVENTION

1. Field of the Invention

The present invention relates to a cutter assembly and, more particularly, to a cutter assembly that is replaceable for a pencil sharpener.

2. Description of Related Art

An electrical pencil sharpener can sharpen a pencil with a motor-driven cutter after the pencil has been inserted into the pencil sharpener. However, the cutter is easily worn and damaged after a term of use, so that the pencil cannot be sharpened as desired or is broken.

In addition, the cutter of the conventional pencil sharpener is connected directly with a transmission device for being connected to and driven by a motor, so the cutter is difficult and even impossible to be detached from the transmission device by a user. When the unchangeable cutter is damaged, the whole pencil sharpener should be thrown away, but this causes waste of money and usable components in the pencil sharpener.

To overcome the shortcomings, the present invention provides a cutter assembly for a pencil sharpener to mitigate or obviate the aforementioned problems.

SUMMARY OF THE INVENTION

The main objective of the invention is to provide a cutter assembly that is replaceable for an electric pencil sharpener.

The cutter assembly has a cutter bracket and a cutter. The cutter bracket has a pencil sharpening hole and an engaging structure. The pencil sharpening hole is defined in the cutter bracket for a pencil to be inserted into the pencil sharpening hole. The engaging structure is formed on the cutter bracket to engage a rotating frame in the electric pencil sharpener. The cutter is mounted rotatably on the cutter bracket.

An electric pencil sharpener in accordance with the present invention comprises a body, a rotating frame, a cutter assembly, a cover and a transmission device. The body has a pencil inserting hole and a cutter replacing hole defined respectively in the body. The rotating frame is mounted rotatably in the body and driven by an electric driving device. The cutter assembly engages detachably the rotating frame, corresponds to the pencil inserting hole and the cutter replacing hole in the body and comprises a cutter bracket and a cutter mounted rotatably on the cutter bracket. The cover is mounted detachably on the cutter replacing hole in the body. The transmission device is mounted between the cover and the cutter assembly to make the cutter rotatable relative to the cutter bracket.

The present invention can achieve the following advantages.

(1) Because the cutter bracket is not connected to the gear assembly of the electric driving device directly but via a rotating frame, the cutter bracket can be removed from the rotating frame and detached from the body easily. Consequently, a damaged or worn cutter can be repaired or replaced with a new one. Thus, to replace a whole electric pencil sharpener is unnecessary, and the cost for using the electric pencil sharpener is lowered.

(2) An air flow can be generated inside the securing frame by fans, formed on the rotating frame, during the rotation of the rotating frame, so a low pressure is generated inside the securing frame. Consequently, air will be sucked and flow into the securing frame from a side of the electric driving device to keep dust or wastes generated during the pencil sharpening process from entering into the electric driving device. This can keep the electric driving device from being damaged.

(3) With a post spring mounted on the rotating frame, an automatically axial aligning effect is provided to keep the rotating frame and the cutter assembly rotating stably.

Other objectives, advantages and novel features of the invention will become more apparent from the following detailed description when taken in conjunction with the accompanying drawings.

DETAILED DESCRIPTION OF PREFERRED EMBODIMENT

Figure 1:
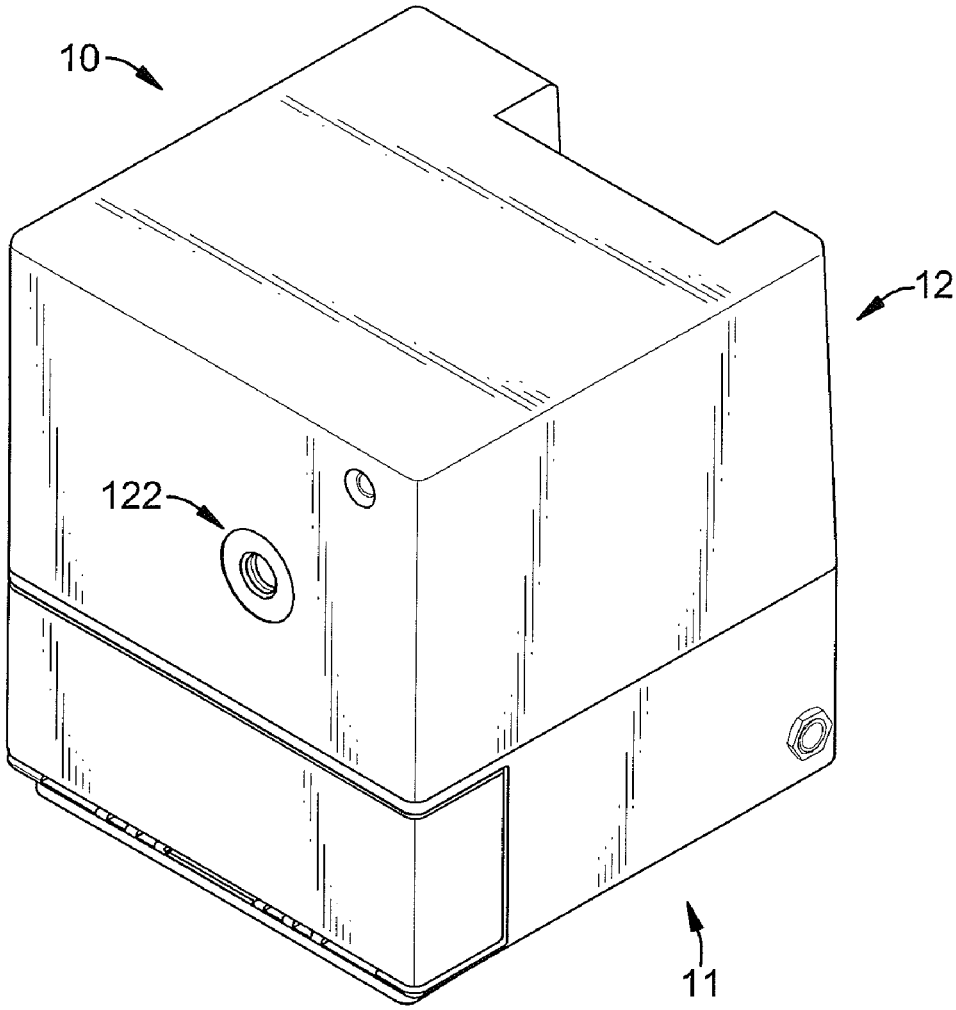
FIG. 1 is a front perspective view of a pencil sharpener in accordance with the present invention.
Figure 2:
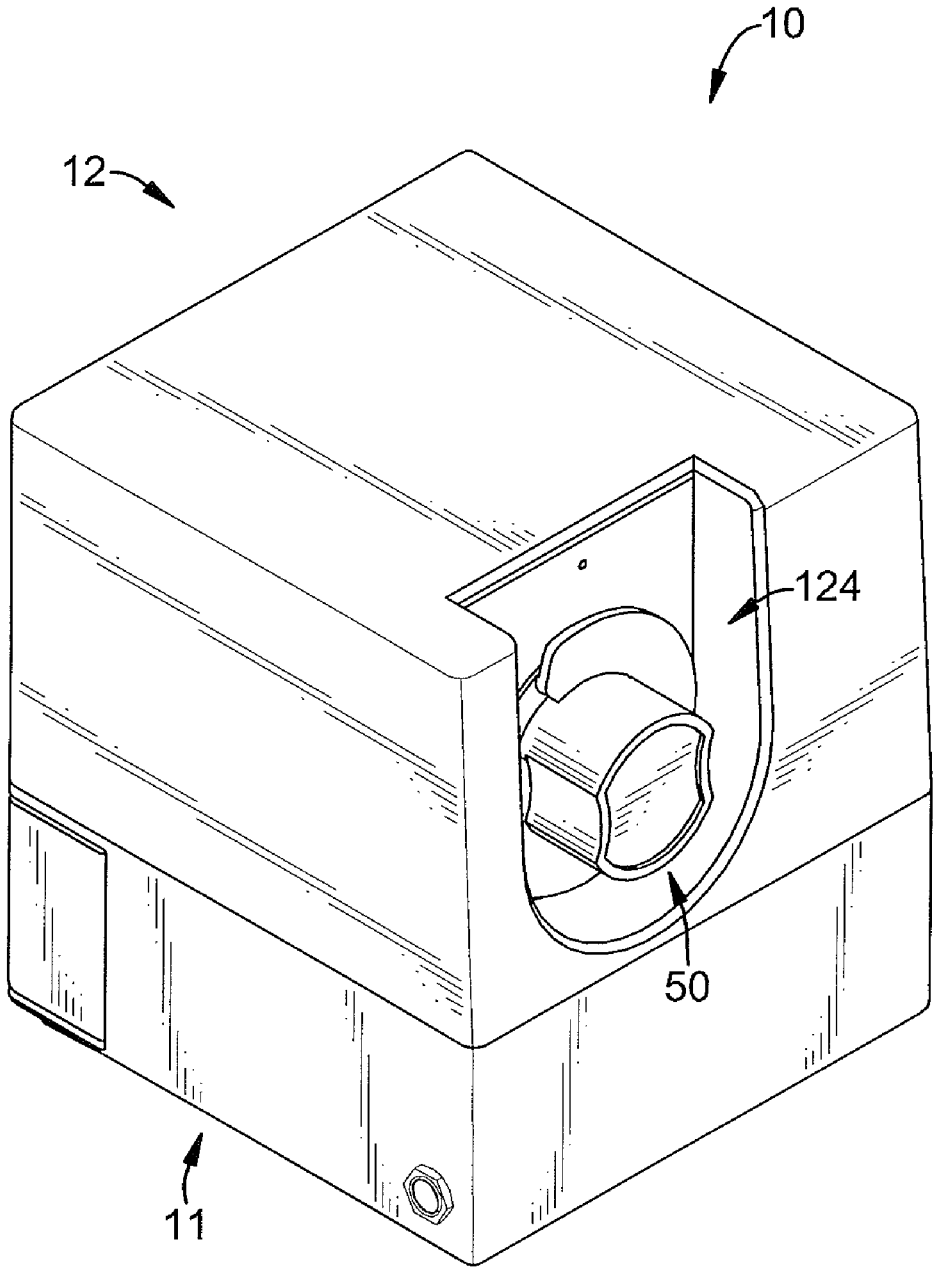
FIG. 2 is a rear perspective view of the pencil sharpener in FIG. 1.
Figure 3:
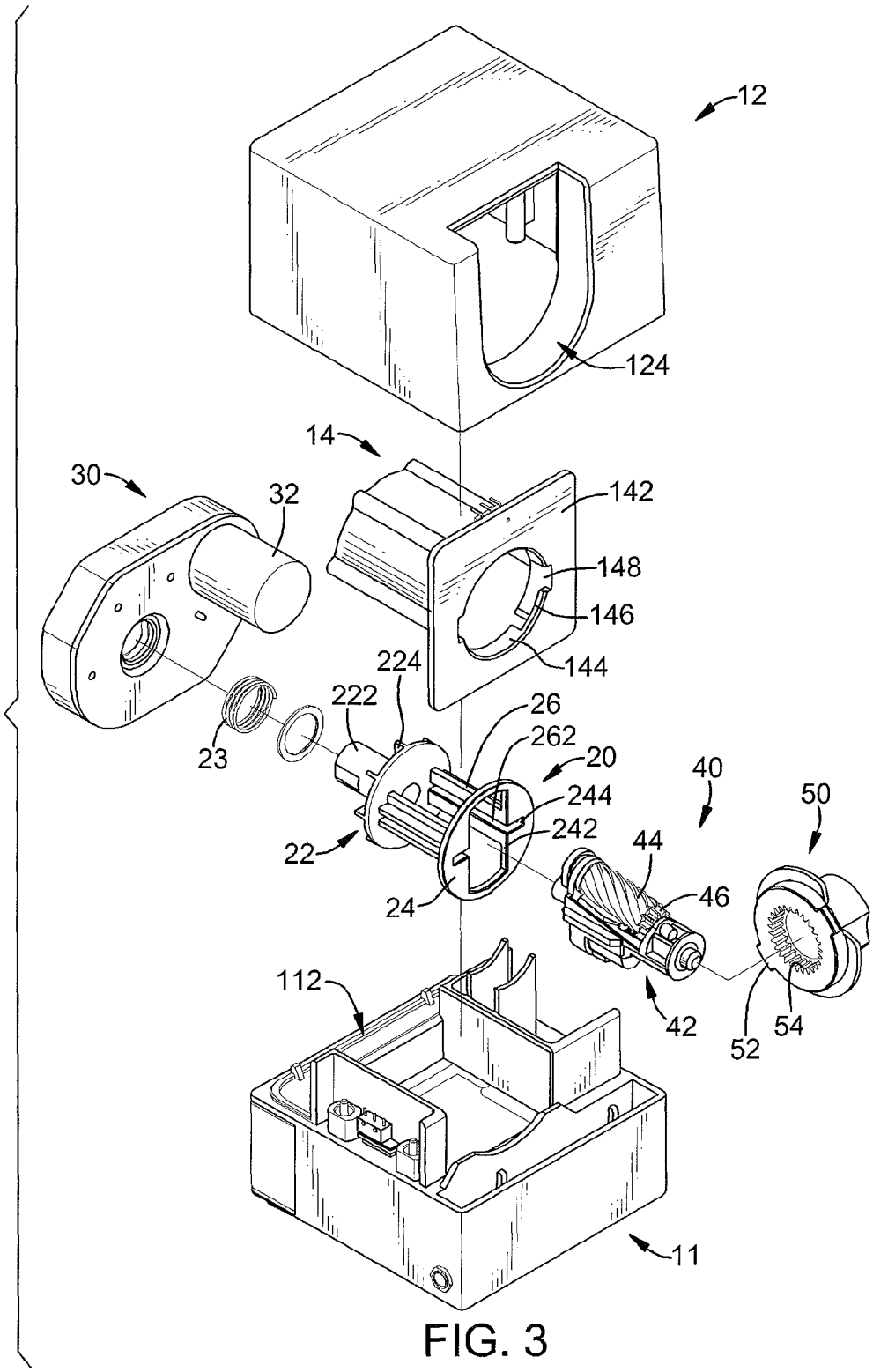
FIG. 3 is an exploded perspective view of the pencil sharpener in FIG. 1.
Figure 4:
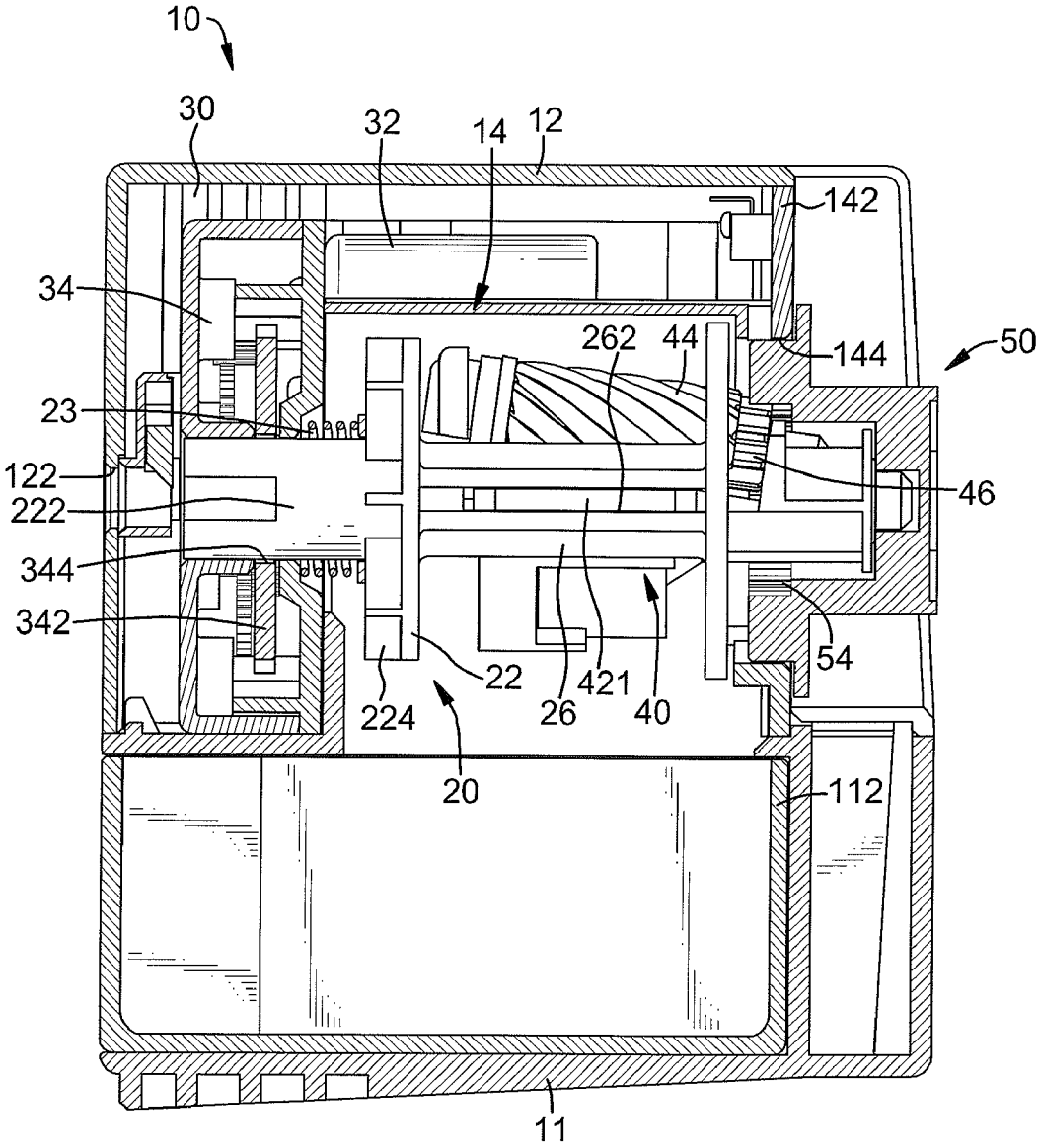
FIG. 4 is a side view in partial section of the pencil sharpener in FIG. 1.

With reference to FIG. 1, an electric pencil sharpener in accordance with the present invention comprises a body (10), a rotating frame (20), an electric driving device (30), a cutter assembly (40), a cover (50) and a transmission device.

The body (10) is hollow and may be composed of a base (11) and a casing (12) combined with each other to define a space for holding the other devices inside. The body (10) has a pencil inserting hole (122) and a cutter replacing hole (144) defined respectively in the body (10). The pencil inserting hole (122) and the cutter replacing hole (144) are defined respectively in two sides of the body (10) and may be defined respectively in the front side and the rear side of the casing (12) of the body (10). The body (10) may further have a waste case (112) mounted in the base (11) to hold dust or waste generated during a pencil being sharpened.

The body (10) may further have a securing frame (14) mounted in the casing (12). The securing frame (14) is tubular and hollow and has an open bottom corresponding to the waste case (112). In the preferred embodiment, the casing (12) has a through hole (124) defined through one side of the casing (12). The securing frame (14) has a closing flange (142) formed around one end of the securing frame (14) to close the through hole (124). The cutter replacing hole (144)

is defined through the closing flange (142), aligns with the through hole (124) and communicates with the securing frame (14).

Figure 5:
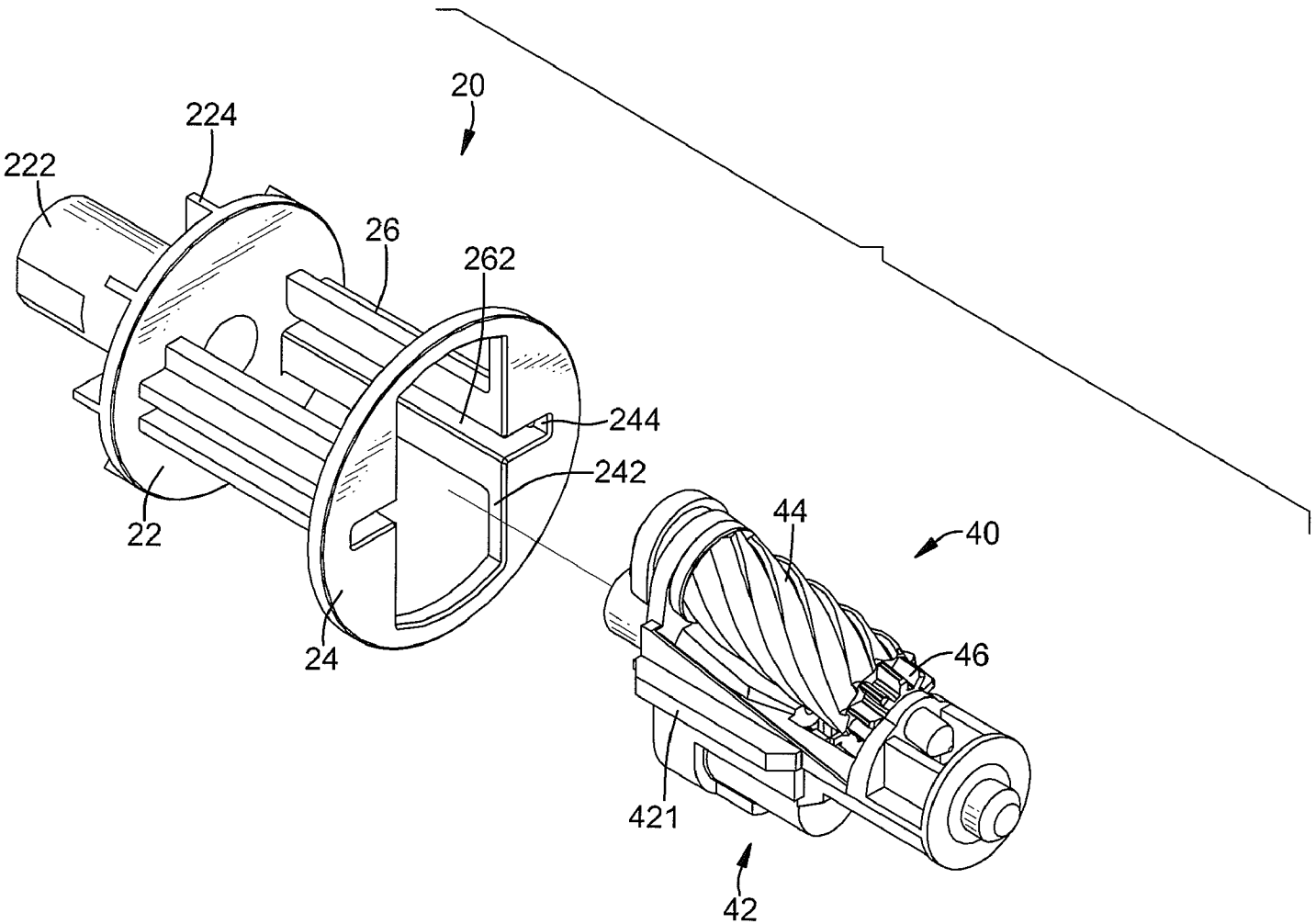
FIG. 5 is an enlarged exploded perspective view of the rotating frame and the cutter assembly of the pencil sharpener in FIG. 3.
Figure 6:
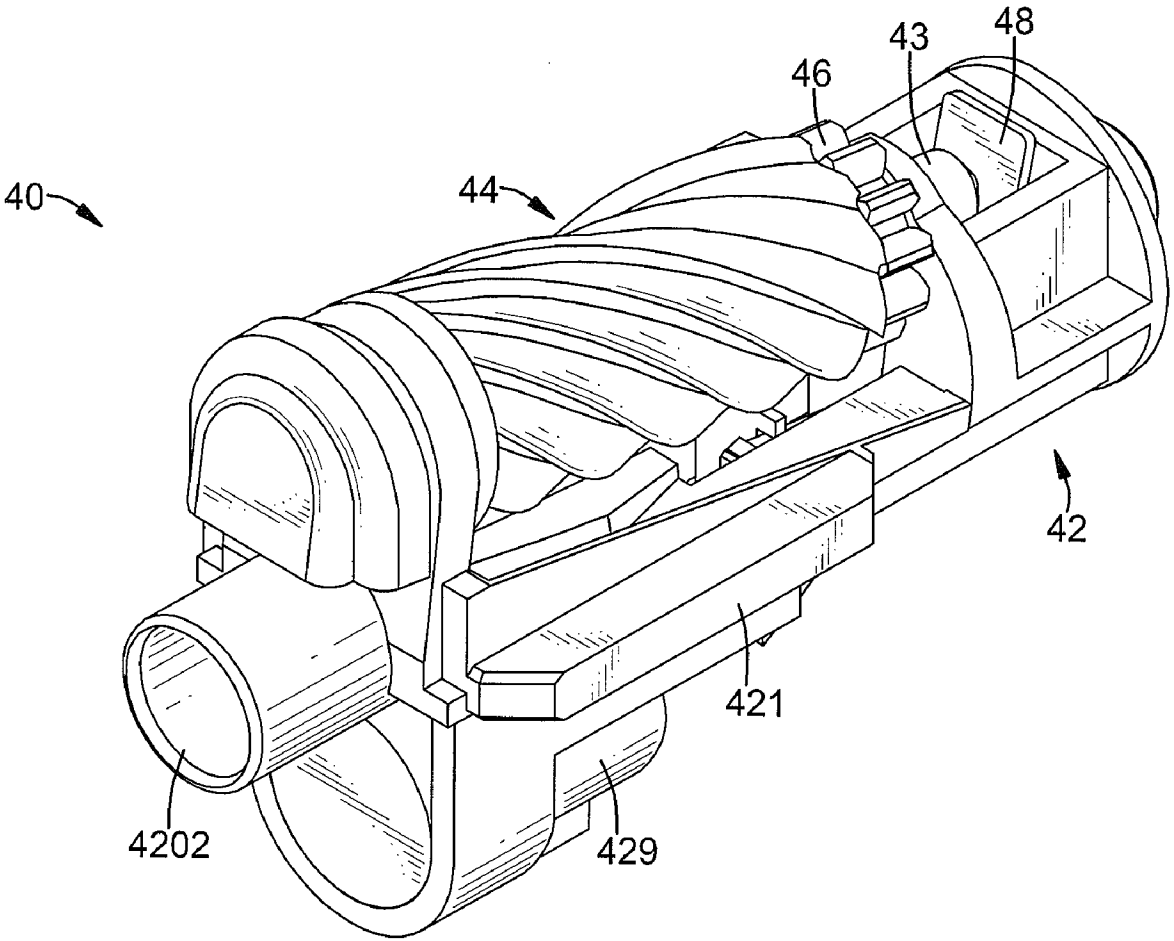
FIG. 6 is a perspective view of a cutter assembly in FIG. 5.
Figure 7:
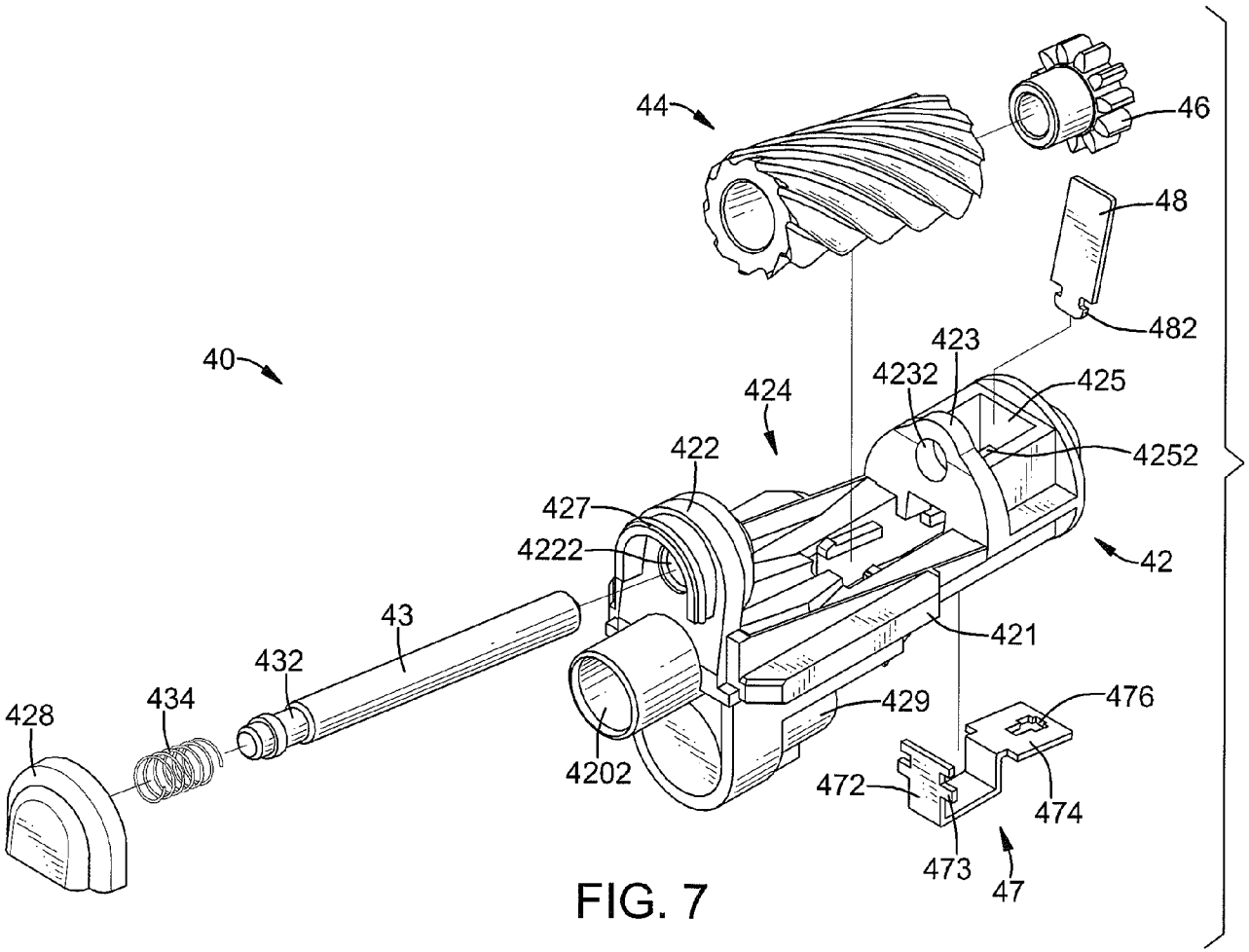
FIG. 7 is an exploded perspective view of the cutter assembly in FIG. 6.
Figure 8:
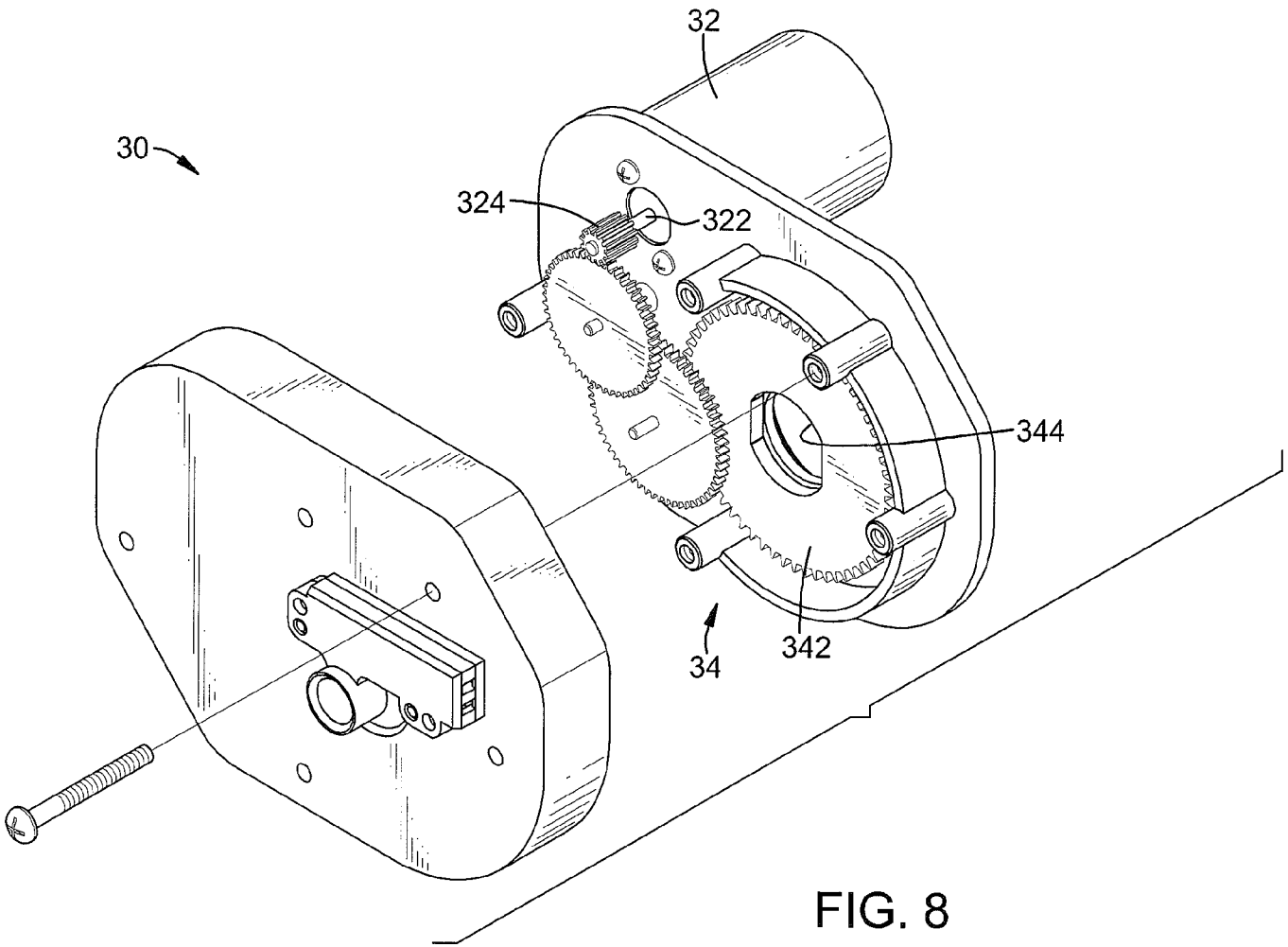
FIG. 8 is an exploded perspective view of the electric driving device of the pencil sharpener in FIG. 3.
Figure 10:
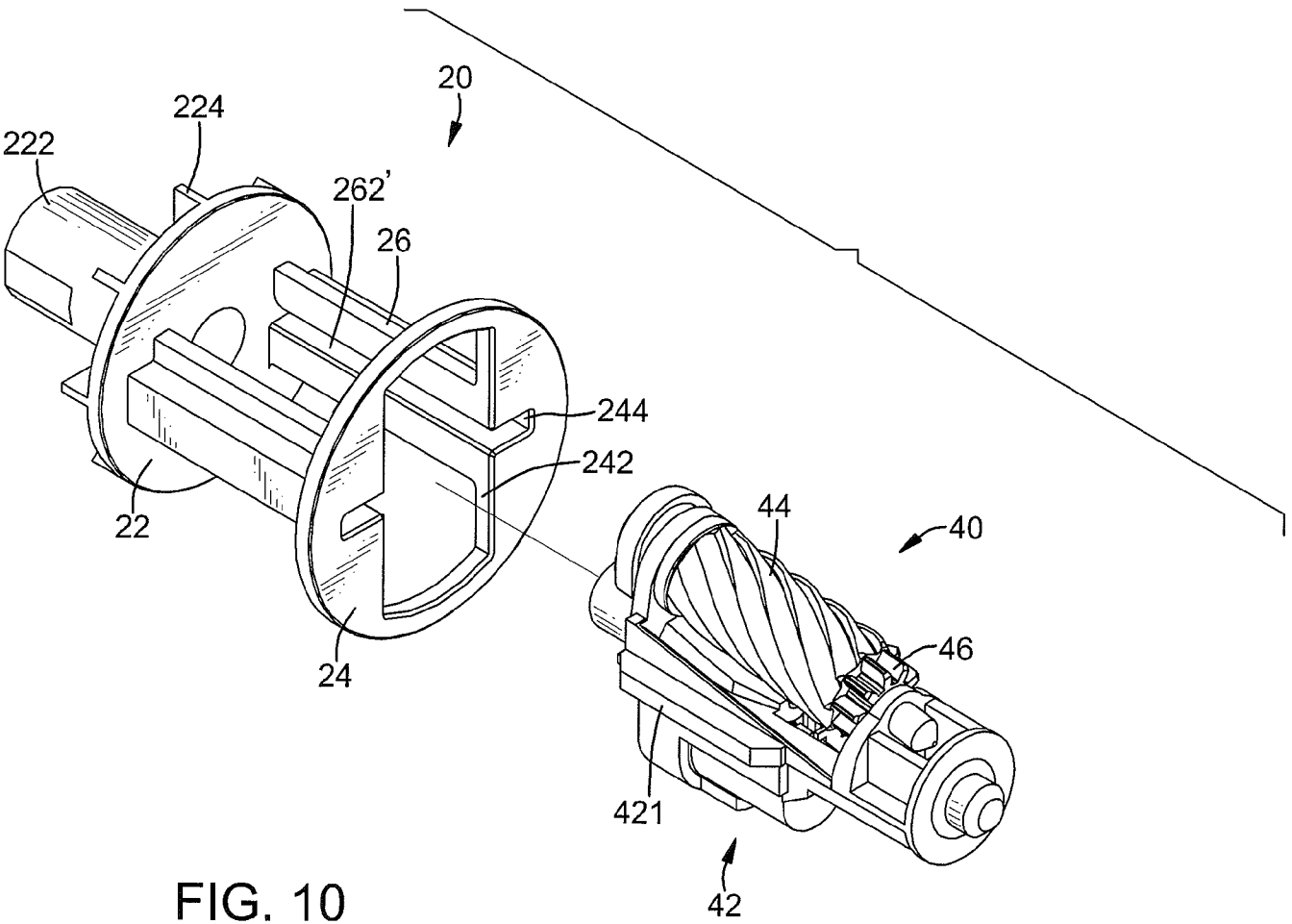
FIG. 10 is an exploded perspective view of an alternative embodiment of a rotating frame and the cutter assembly of the pencil sharpener in accordance with the present invention.
Figure 11:
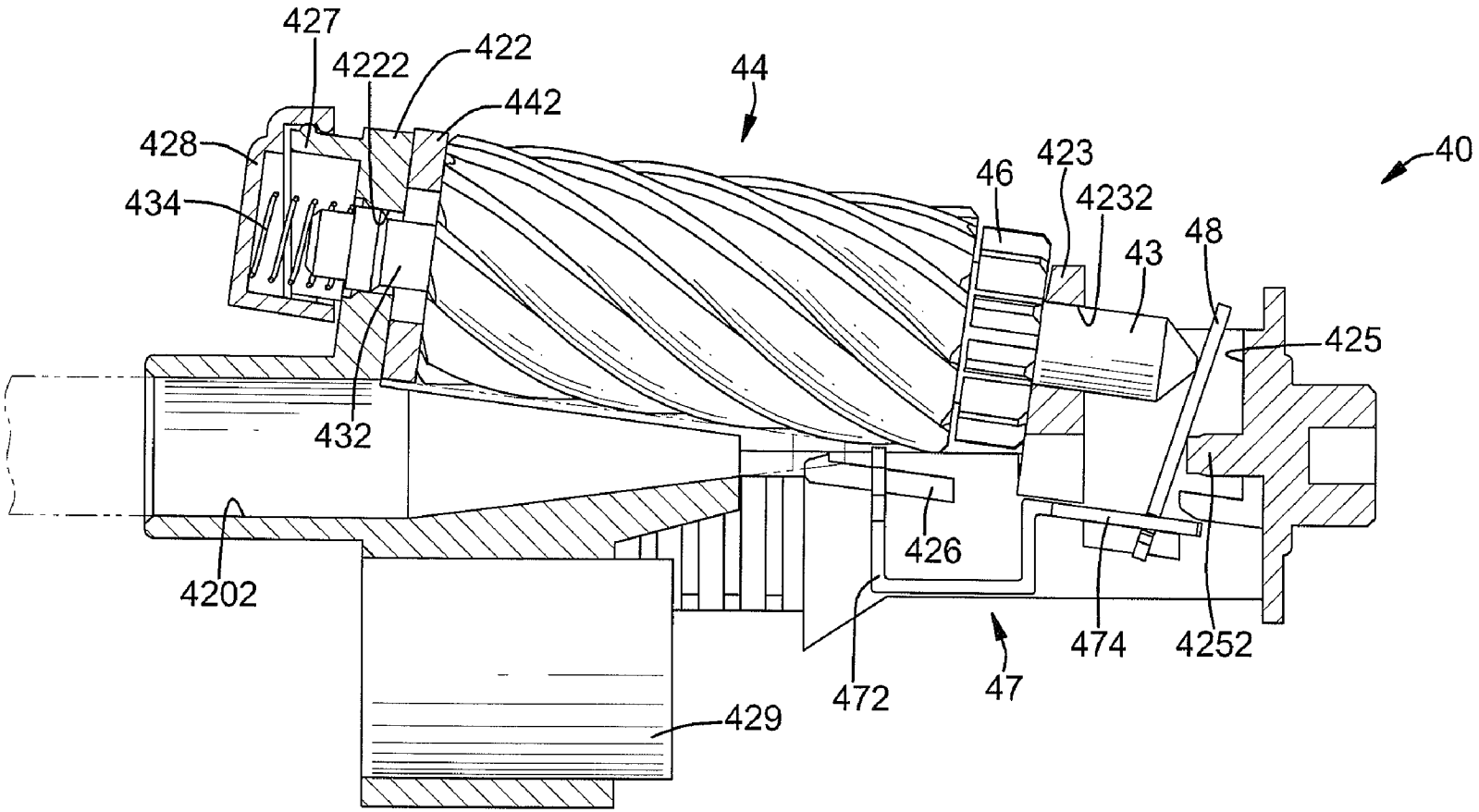
FIG. 11 is an operational side view in partial section of the cutter assembly in FIG. 6 showing a pencil being inserted into the pencil sharpening hole and sharpened.

The rotating frame (20) is mounted rotatably in the body (10) and driven by the electric driving device (30). The rotating frame (20) may be mounted rotatably in the securing frame (14) and comprises a front panel (22), a rear panel (24), at least one connecting rod (26) and a first engaging structure. The front panel (22) and the rear panel (24) are parallel and connected with each other by the at least one connecting rod (26). Preferably, the rotating frame (20) may have two connecting rods (26). The front panel (22) has a driven post (222), a post spring (23) and multiple fans (224). The driven post (222) is formed on and protrudes from the front panel (22) at a side opposite to the rear panel (24), is connected to the electric driving device (30) and has a noncircular cross section. The post spring (23) is mounted around the driven post (222). The multiple fans (224) are formed on the front panel (22) and around the driven post (222). The rear panel (24) has a cutter holding hole (242) defined through the rear panel (24) and aligned with the cutter replacing hole (144) in the body (10). The cutter holding hole (242) may be elongated and has at least one notch (244) defined in an inner edge of the cutter holding hole (242). In the preferred embodiment, two notches (244) are implemented. The connecting rods (26) are mounted between the front and rear panels (22,24) to connect the front and rear panels (22,24) together and align respectively with the notches (244) in the rear panel (24). Each connecting rod (26) has an engaging recess (262) defined in the connecting rod (26) and aligned with a corresponding one notch (244) in the rear panel (24). In the embodiment shown in FIG. 5, the engaging recess (262) is defined through the connecting rod (26). In an alternative embodiment shown in FIG. 10, an engaging recess (262') is defined in the connecting rod (26) and has a closed bottom. The engaging recesses (262,262') can serve as the first engaging structure on the rotating frame (20). The electric driving device (30) is mounted in the body (10) to drive the rotating frame (20) rotating relative to the body (10). With further reference to FIG. 8, the electric driving device (30) comprises a motor (32), a driving gear (324) and a gear assembly (34). The motor (32) is mounted in the body (10) and has a rotating shaft (322). The driving gear (324) is mounted securely on the rotating shaft (322). The gear assembly (34) has multiple gears engaging each other and the driving gear (324) and includes a driven gear (342) mounted around the driven post (222) on the front panel (22) of the rotating frame (20). The driven gear (342) has a noncircular central hole (344) mounted around the noncircular driven post (222), such that the rotating frame (20) can be rotated by the motor (32) with the transmission of the driving gear (324) and the gear assembly (34).

The cutter assembly (40) engages detachably and rotates with the rotating frame (20), is held in the rotating frame (20) via the cutter holding hole (242) in the rear panel (24) and corresponds to the pencil inserting hole (122) and the cutter replacing hole (144) in the body (10). With reference to FIGS. 5 to 7 and 11, the cutter assembly (40) has a cutter bracket (42), a cutter axle (43), an axle spring (434), a cutter (44), a pushing board (47) and a supporting board (48).

The cutter bracket (42) is held in and engages the rotating frame (20) and comprises a pencil sharpening hole (4202), a second engaging structure, a weight (429), a front axle mount (422), a rear axle mount (423), a recess (425) and an abutting protrusion (4252). The pencil sharpening hole (4202) is defined in the cutter bracket (42) and has a length extending from the front end of the cutter bracket (42) for a pencil to be inserted into the pencil sharpening hole (4202). The second engaging structure is formed on the cutter bracket (42) and engages the first engaging structure on the rotating frame (20) to make the cutter bracket (42) rotatable with the rotating frame (20). The second engaging structure comprises at least one rib (421) formed on the cutter bracket (42) and engaging respectively at least one engaging recess (262) in the rotating frame (20). In the preferred embodiment, two ribs (421) are implemented and formed respectively on two sides of the cutter bracket (42). The weight (429) is mounted on the bottom of the cutter bracket (42) to enable the cutter bracket (42) to rotate stably. The front axle mount (422) and the rear axle mount (423) are formed separately on the top of the cutter bracket (42) to define a cutter space (424) between the axle mounts (422,423). Each axle mount (422,423) has an axle hole (4222,4232) defined through the axle mount (422,423) and aligned with each other. The cutter space (424) has an opened bottom and communicates with the pencil sharpening hole (4202) via the opened bottom. The recess (425) is defined in the top of the cutter bracket (42) adjacent to the rear axle mount (423). The abutting protrusion (4252) is formed on and protrudes from the inner surface of the recess (425). The cutter axle (43) is mounted between the axle holes (4222, 4232) in the axle mounts (422,423). The cutter axle (43) has a diameter substantially the same as that of the axle holes (4222,4232) to make the cutter axle (43) mounted between the axle holes (4222,4232) stable. The cutter axle (43) has a front end, a rear end and an annular groove (432). The front end is mounted in/through the axle hole (4222) in the front axle mount (422). The rear end is mounted through the axle hole (4232) in the rear axle mount (423) and extends into the recess (425). The annular groove (432) is defined around the cutter axle (43) near the front end to define a neck having a diameter smaller than that of the axle hole (4222) in the front axle mount (422).

The axle spring (434) is mounted around the front end of the cutter axle (43) to provide a pushing force to the cutter axle (43) to make the neck on the cutter axle (43) move away from the axle hole (4222) in the front axle mount (422). In addition, the cutter bracket (42) further has a flange (427) and a front cap (428). The flange (427) may be curved and is formed on and protrudes from the front axle mount (422) at a side facing the front end of the cutter bracket (42). The front cap (428) is attached to the flange (427) to define a spring space into which the front end of the cutter axle (43) extends. The axle spring (434) is held in the spring space defined between the front cap (428) and the flange (427) and abuts with the front cap (428).

The cutter (44) is mounted rotatably around the cutter axle (43), is mounted rotatably in the cutter space (424) between the axle mounts (422,423) on the cutter bracket (42) and may be a cylindrical hobbing cutter or planing cutter. The cutter (44) has an axis oblique to an axis of the cutter bracket (42) and a periphery extending partially into the pencil sharpening hole (4202) via the opened bottom of the cutter space (424) to sharpen a pencil inserted into the pencil sharpening hole (4202) via the pencil inserting hole (122) in the body (10). Additionally, a gasket (442) is attached to the cutter (44) at an end facing the front end of the cutter bracket (42) and is mounted around the cutter axle (43).

The pushing board (47) is mounted slidably on the bottom of the cutter bracket (42) at a position corresponding to the pencil sharpening hole (4202), may be L-shaped and comprises an abutting tab (472) and a connecting tab (474). The abutting tab (472) is formed on the front end of the pushing board (47) and faces the pencil sharpening hole (4202). The abutting tab (472) has two sides and two pairs of guiding tabs (473) formed respectively on the sides of the abutting tab (472). The cutter bracket (42) further has two guiding ribs (426) formed on the bottom of the cutter bracket (42) and respectively engaging slidably the pairs of the guiding tabs (473) on the pushing board (47). With the engagement between the guiding tabs (473) and the guiding ribs (426), the pushing board (47) is slidable relative to the cutter bracket (42). The connecting tab (474) is formed on the rear end of the pushing board (47), protrudes laterally from the abutting tab (472) and has a connecting hole (476) defined in the connecting tab (474).

The supporting board (48) is connected swingably to the connecting tab (474) of the pushing board (47), is mounted in the recess (425) in the cutter bracket (42) and has two faces and a connecting protrusion (482). The faces abut respectively against the rear end of the cutter axle (43) and the abutting protrusion (4252). The connecting protrusion (482) is formed on the bottom of the supporting board (48) and is mounted swingably in the connecting hole (476) in the connecting tab (474) of the pushing board (47).

The cover (50) is mounted detachably on and closes the cutter replacing hole (144) in the body (10). The cover (50) has at least one combining tab (52) formed on the cover (50). The cutter replacing hole (144) further has at least one combining flange (146) formed on the inner edge of the cutter replacing hole (144) and engaging respectively the at least one combining tab (52) on the cover (50). In the preferred embodiment, two combining tabs (52) and two combining flanges (146) are implemented. Additionally, the combining flanges (146) are curved and separated from each other to define two passages (148) between the combining flange (146) to allow the combining tabs (52) to pass through the passages (148). When the cover (50) is attached to the body (10) and the combining tabs (52) pass through the passages (148), the cover (50) is then rotated to make the combining tabs (52) abutting against and engaging the combining flanges (146) to securely combine the cover (50) in the cutter replacing hole (144).

Figure 9:
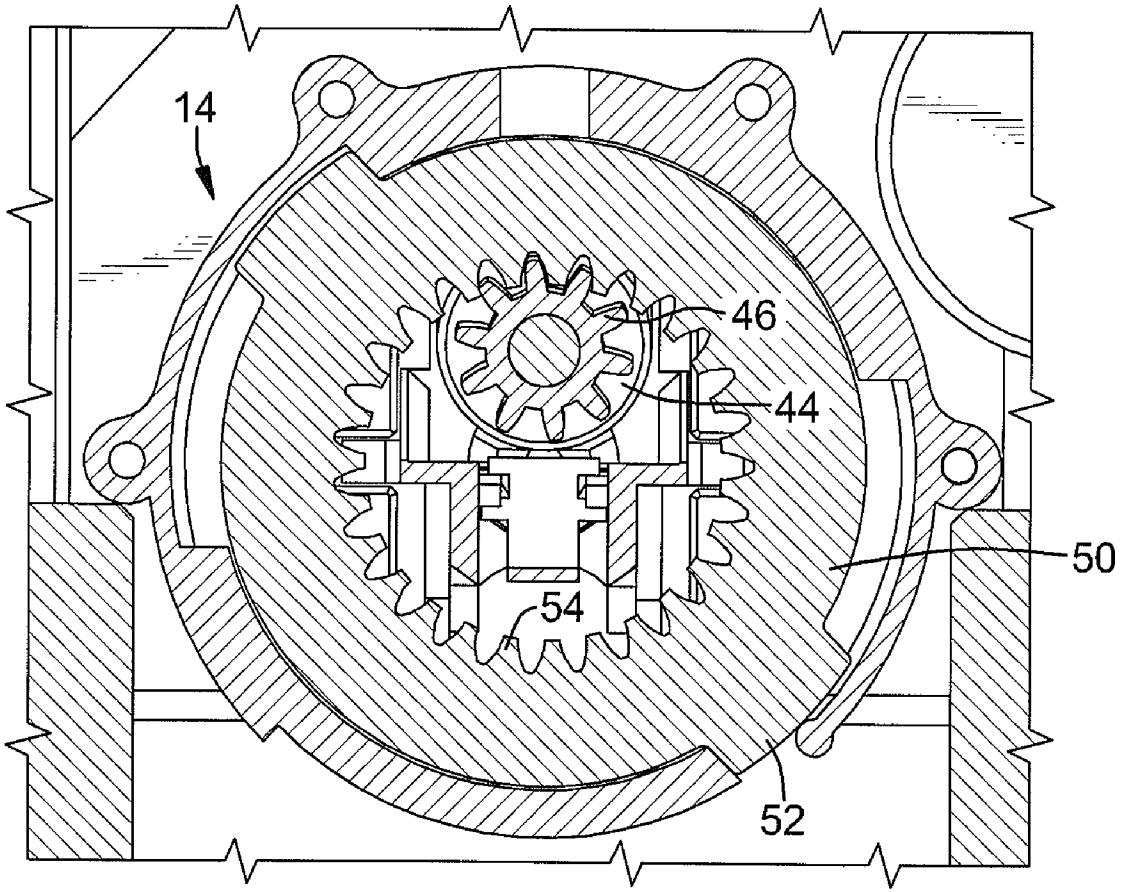
FIG. 9 is an enlarged rear view in partial section of the pencil sharpener in FIG. 1.

With further reference to FIG. 9, the transmission device is mounted between the cover (50) and the cutter assembly (40) to make the cutter (44) rotatable relative to the cutter bracket (42). The transmission device comprises an inner gear (54) and a cutter gear (46). The inner gear (54) is formed in the cover (50). The cutter gear (46) is mounted co-axially and securely on the cutter (44) around the cutter axle (43) and engages the inner gear (54) in the cover (50). With the engagement between the inner gear (54) and the cutter gear (46), the cutter (44) will rotate relative to the cutter bracket (42) while the cutter bracket (42) rotates with the rotating frame (20).

In use, with reference to FIGS. 1, 4, 8 and 11, a pencil is inserted into the pencil sharpening hole (4202) via the pencil inserting hole (122) in the body (10). The rotating frame (20) and the cutter bracket (42) are rotated relative to the body (10) by the motor (32) of the electric driving device (30) with the transmission of the gear assembly (34). During the rotation of the cutter bracket (42), the cutter (44) will rotate relative to the cutter bracket (42) with the engagement between the cutter gear (46) and the inner gear (54) in the cover (50). Accordingly, the pencil can be sharpened by the rotating cutter (44) on the rotating cutter bracket (42).

Figure 12:
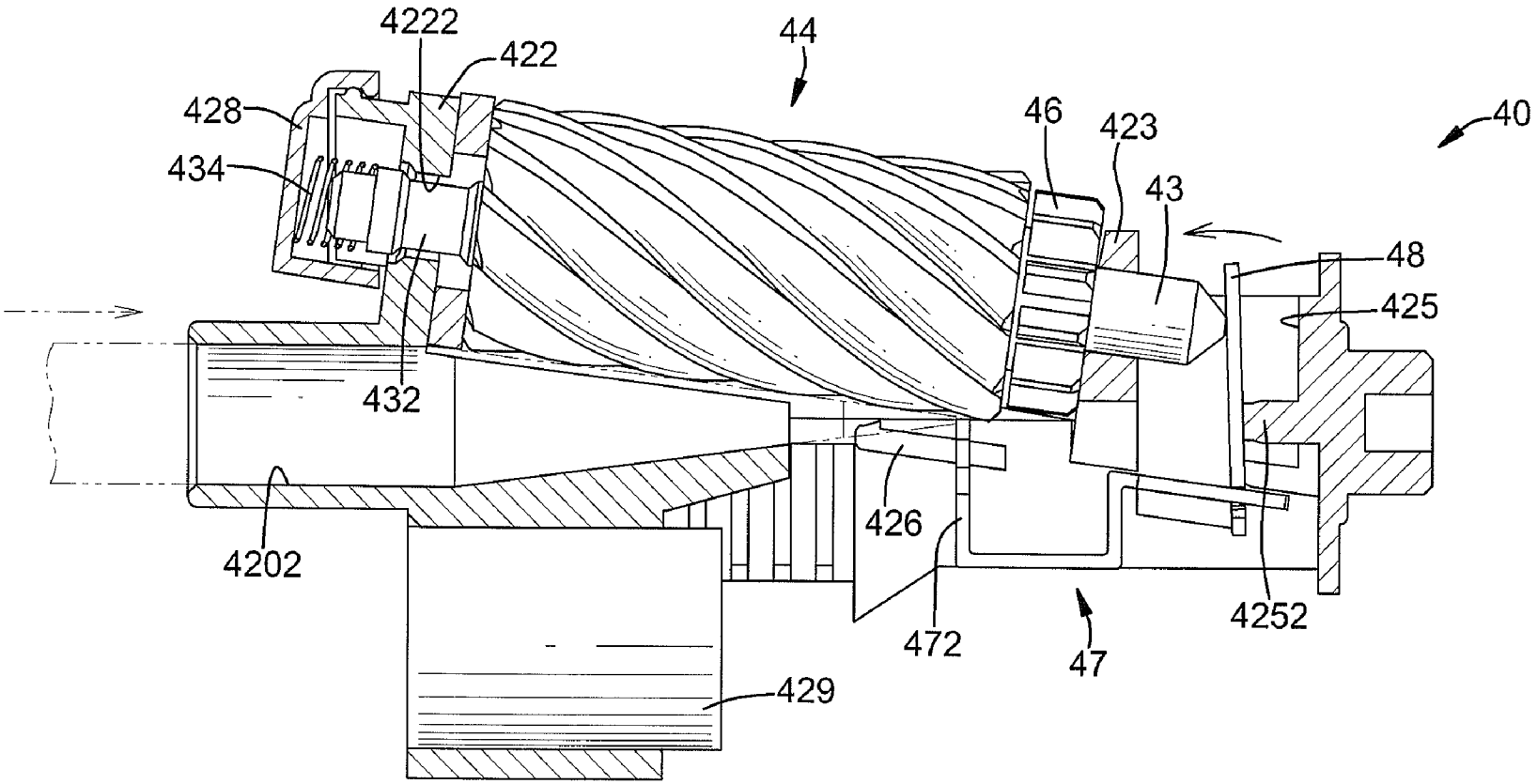
FIG. 12 is an operational side view in partial section of the cutter assembly in FIG. 6 showing the pushing board being pushed by the sharpened pencil.

With reference to FIG. 12, when the pencil has been sharpened, the tip of the pencil will push against the abutting tab (472) of the pushing board (47) to slide the pushing board (47) relative to the cutter bracket (42). With the movement of the pushing board (47), the supporting board (48) will be swung in the recess (425) to push the cutter axle (43) moving toward the front end of the cutter bracket (42). When the cutter axle (43) is moved to a position where the neck is held in the axle hole (4222) in the front axle mount (422), the cutter axle (43) with the cutter (44) will swing relative to the axle mounts (422,423) due to the neck having a diameter smaller than that of the axle hole (4222) in the front axle mount (422). Consequently, the pencil will not be further sharpened and can be kept from being overly sharpened. When the sharpened pencil is removed from the pencil sharpening hole (4202), the cutter axle (43) will be pushed to a position where the neck is away from the axle hole (4222) in the front axle mount (422) by the force provided by the axle spring (434). Accordingly, the supporting board (48) and the pushing board (47) will also move to the original positions to wait for another sharpening process.

When the cutter (44) is worn or damaged, the cover (50) is detached from the cutter replacing hole (144) in the body (10) after the cover (50) is rotated aligning the combining tabs (52) with the passages (148) between the combining flanges (146). With the engagement between the inner gear (54) and the cutter gear (46), the inner gear (54) can be easily disengaged from the cutter gear (46), and the cover (50) can be easily detached from the body (10). Because the cutter bracket (42) is not connected to the gear assembly (34) of the electric driving device (30) directly, the cutter bracket (42) can be removed from the rotating frame (20) and detached from the body (10) via the cutter replacing hole (144) in the body (10) easily. Consequently, the damaged or worn cutter (44) can be repaired or replaced with a new one, and the cutter bracket (42) with the new or repaired cutter (44) can be recombined with the rotating frame (20). Accordingly, to replace a whole electric pencil sharpener is unnecessary, and the cost for using the electric pencil sharpener is lowered.

Furthermore, when the rotating frame (20) is rotating, an air flow can be generated inside the securing frame (14) by the fans (224) on the rotating frame (20) to generate a low pressure inside the securing frame (14). Consequently, air will be sucked and flow into the securing frame (14) from a side of the electric driving device (30) to keep dust or waste generated during the pencil sharpening process from entering into the electric driving device (30). Furthermore, a guiding effect is provided to lead the dust or waste into the waste case (112).

With the post spring (23) mounted around the driven post (222), an automatically axial aligning effect is provided to keep the rotating frame (20) and the cutter assembly (40) rotating stably.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric pencil sharpener comprising a body having a pencil inserting hole and a cutter replacing hole defined respectively in two sides of the body;

an electric driving device mounted in the body;

a rotating frame mounted rotatably in the body and driven by the electric driving device;

a cutter assembly engaging detachably the rotating frame, wherein the cutter assembly corresponds to the pencil inserting hole and the cutter replacing hole in the body and comprises a cutter bracket; and a cutter mounted rotatably on the cutter bracket;

a cover mounted detachably on the cutter replacing hole; and a transmission device mounted between the cover and the cutter assembly to make the cutter rotatable relative to the cutter bracket.

2. The electric pencil sharpener as claimed in claim 1, wherein the body further has a casing;

a through hole defined in the casing;

a hollow securing frame mounted in the casing and having an open bottom and a closing flange formed around one end of the securing frame to close the through hole; and a waste case mounted in the body and corresponding to the open bottom of the securing frame; and the cutter replacing hole is defined through the closing flange, aligns with the through hole and communicates with the securing frame.

3. The electric pencil sharpener as claimed in claim 1, wherein the rotating frame comprises a front panel having a driven post connected to the electric driving device;

a rear panel having a cutter holding hole defined through the rear panel;

at least one connecting rod mounted between the front and rear panels to connect the front and rear panels together; and a first engaging structure formed on the rotating frame; and the cutter bracket of the cutter assembly further has a second engaging structure formed on the cutter bracket and engaging the first engaging structure on the rotating frame.

4. The electric pencil sharpener as claimed in claim 3, wherein the electric driving device comprises a motor mounted in the body and having a rotating shaft;

a driving gear mounted securely on the rotating shaft; and a gear assembly having multiple gears engaging each other and the driving gear and including a driven gear mounted around the driven post on the front panel of the rotating frame.

5. The electric pencil sharpener as claimed in claim 1, wherein the transmission device comprises an inner gear formed in the cover; and a cutter gear mounted co-axially and securely on the cutter of the cutter assembly and engaging the inner gear in the cover.

6. The electric pencil sharpener as claimed in claim 3, wherein the front panel of the rotating frame further has multiple fans formed on the front panel and around the driven post.

7. The electric pencil sharpener as claimed in claim 3, wherein the rear panel of the rotating frame further has at least one notch defined in an inner edge of the cutter holding hole;

the first engaging structure on the rotating frame is at least one engaging recess defined in the at least one connecting rod and aligning respectively with the at least one notch in the cutter holding hole of the rear panel; and the second engaging structure on the cutter bracket is at least one rib formed on the cutter bracket and engaging respectively the at least one engaging recess in the rotating frame.

8. The electric pencil sharpener as claimed in claim 7, wherein the at least one engaging recess is defined through the at least one connecting rod.

9. The electric pencil sharpener as claimed in claim 7, wherein the at least one engaging recess is defined in the at least one connecting rod and having a closed bottom.

10. The electric pencil sharpener as claimed in claim 3, wherein the rotating frame further has a post spring mounted around the driven post.

* * * * *

UNITED STATES PATENT AND TRADEMARK OFFICE

CERTIFICATE OF CORRECTION

PATENT NO. : 8,205,649 B2
APPLICATION NO. : 12/652097
DATED : June 26, 2012
INVENTOR(S) : Long-Jyi Yeh et al.

It is certified that error appears in the above-identified patent and that said Letters Patent is hereby corrected as shown below:

Title page, item (75), line 3, cancel "lai" and substitute therefore --Lai--.

Signed and Sealed this
Seventh Day of August, 2012

David J. Kappos

David J. Kappos
*Director of the United States Patent and Trademark Office*